US005688339A

United States Patent [19]

Farmer et al.

[11] Patent Number: 5,688,339

[45] Date of Patent: Nov. 18, 1997

[54] OXY-FUEL FLAME IMPINGEMENT HEATING OF METALS

[75] Inventors: Larry Keith Farmer, Fleetwood; Michael Dennis Lanyi, Macungie; Joseph Scott Becker, Schnecksville; Christopher Alan Ward, Alburtis, all of Pa.

[73] Assignee: Gas Research Institute, Chicago, Ill.

[21] Appl. No.: 292,657

[22] Filed: Aug. 18, 1994

Related U.S. Application Data

[63] Continuation of Ser. No. 81,994, Jun. 23, 1993, abandoned.

[51] Int. Cl.[6] ..... B23K 7/00

[52] U.S. Cl. ..... 148/194; 148/195

[58] Field of Search ..... 148/559, 203, 148/205, 642, 194, 195, 196; 266/261

[56] References Cited

U.S. PATENT DOCUMENTS

| | | | |
|---|---|---|---|
| 3,953,247 | 4/1976 | Elhaus et al. | 148/157 |
| 4,549,866 | 10/1985 | Granville | 432/10 |
| 4,756,685 | 7/1988 | Davies et al. | 431/160 |

OTHER PUBLICATIONS

Metals Handbook, Heat Treating, 9th Edition, vol. 4, American Society for Metals, 1979, pp.486–487.

*Primary Examiner*—Sikyin Ip

[57] ABSTRACT

Heating metal articles by direct surface impingement of an oxy-fuel flame without causing damage, or surface melting of the articles being heated. Flame contact is cycled to achieve maximum allowable rate of heat introduction thereby substantially reducing the time and energy required to achieve the final desired piece temperature.

11 Claims, 1 Drawing Sheet

OXY-FUEL FLAME IMPINGEMENT HEATING OF METALS

This is a continuation of application Ser. No. 08/081,994 filed 23 Jun. 1993 now abandoned.

FIELD OF THE INVENTION

The present invention pertains to heating of shaped metals, e.g. billets, for subsequent fabrication operations, e.g. forging or rolling.

BACKGROUND OF THE INVENTION

In many metal fabrication operations, e.g. rolling, forging, bending and the like, the metals must be heated prior to being subjected to the operation. It is well known that metals are deformed more easily at relatively high temperatures, permitting significant size reduction during fabrication. Conventional heating methods typically employ fossil fuel combustion to produce heat which is introduced into a furnace or other heating device. Heating of the metal generally takes place by radiation from the refractory contained inside the furnace so that the heat is transferred to the product. As the metal is being heated to a temperature dictated by the subsequent operation, the rate of heat transfer slows significantly since the temperature difference between the metal and the refractory is generally very small. Long heating times subject the product to oxidizing conditions for longer periods resulting in increased scale formation. Increased scale formation can lead to surface defects, additional unwanted loss in yield, and increased costs for finishing operations when the metal is cooled to room temperature. Additionally, in conventional heating operations the refractory represents a large thermal mass which requires substantial energy input to reach and maintain a desired temperature. Thus, conventional heating methods constrain operating flexibility, lead to yield losses due to product oxidation, and often are the limiting factor in productivity of a particular operation. Lastly, conventional heating methods are ill-suited for future heating needs of the metals industry as the industry adopts continuous processes such as direct rolling which are aimed at reducing total manufacturing costs for basic metal products.

In the ever-increasing competitiveness in the global metal markets, the U.S. metals producers must improve all facets of their manufacturing processes and reduce operating costs while improving product quality and consistency. Thus producers are seeking ways to lower their current operating costs while pursuing new technologies such as increased use of continuous metal processing processes. Induction heating possesses the technical capabilities for use in a continuous metal producing process. However, high capital and operating costs associated with induction heating and poor maintenance records have significantly restricted its implementation. Air-natural gas heating technology aimed at improving performance of gas-based heating systems has been developed which has improved both the thermal efficiency and heating rate of conventional small scale furnaces. However, air-natural gas heating lacks the speed of induction heating and it does not address the needs of a major portion of the metals industry. Examples of air-natural gas heating technology using flame impingement techniques are shown in U.S. Pat. Nos. 3,291,456; 4,333,777; 4,549,866; and 5,007,824.

SUMMARY OF THE INVENTION

The present invention is a process for rapid heating of metal shapes by directly impinging an oxy-gaseous fuel flame onto the surface of the metal being heated. Direct impingement of the flame produced by the oxy-fuel gas mixture develops a very high heat transfer rate to the surface of the metal and substantially reduces overall heating times. Control of the firing rate, firing time and stoichiometry of the flame effects the desired heating process which may be employed for either total or incremental heating of a metal shape.

DETAILED DESCRIPTION OF THE INVENTION

Figure 1:
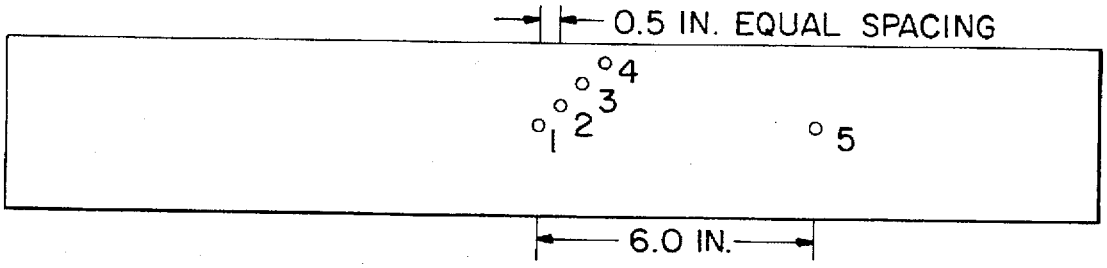
FIG. 1 is an elevational view of a test billet used to demonstrate the present invention showing thermocouple placement.

The present invention solves the problem of the shortcomings of conventional heating methods by providing the end user with a rapid heating process that is efficient, economical and can be utilized in a multitude of applications within the metals producing industry. According to the present invention, directly impinging the products of combustion from an oxygen-hydrocarbon gas flame onto the surface of the product undergoing heating develops high heat transfer rates to the surface of the product and reduces overall heating times. By controlling firing rate, firing time and stoichiometry, the desired heating efficiency is obtained. Furthermore, since the heat is being applied directly to the product, (that is, the heat is applied directly to the product, rather than into a furnace which must indirectly re-radiate the heat into the product) the process may be operated intermittently without substantial energy cost penalties. The process may be employed for either total or incremental heating of a product.

Combustion of a hydrocarbon such as natural gas with high purity oxygen (greater than 90%) produces very high adiabatic flame temperatures (approximately 5000° F.). The products of combustion, carbon dioxide and water, dissociate at these elevated temperatures. When the products of combustion impinge a relatively cool surface, the dissociated species re-combine. This recombinant reaction is exothermic resulting in significant heat input to the surface. Additionally, the radiation component of heat transfer from the oxygen-hydrocarbon gas flame is also extremely high due to the high flame temperature. The final mode of heat transfer from the flame to the metal is convection. While this mode of heat transfer is not dominant compared to others, it also contributes to the high heating rates obtained. During convective heat transfer in the process of the present invention, heat is exchanged from the combustion products flowing over the metal surface. These effects, together with the favorable shape factor relationship between the flame and the product all work together to produce a heat transfer rate and heating flux which is much higher than any traditional method of heating.

According to the present invention, a burner such as disclosed and claimed in U.S. Pat. No. 4,756,685, the specification of which is incorporated herein by reference, is used to direct an oxy-fuel flame at a metal shape to be heated. For example, such a heater can be used to heat a metal billet having approximately a 4" by 4" cross-section which is then subjected to a drop or hammer forging operation. According to the present invention, the oxy-fuel flame is directed onto the surface of the billet until the surface in contact with the flame reaches a maximum temperature equal to or greater than that to which the metal is to be heated, but below that at which either the material melts or the surface of the piece becomes subject to metallurgical damage. The maximum temperature to which the metal is to be heated is determined by the particular composition of the metal and the operation to which it is subjected, all of which are well known to a workers skilled in the art. At the time the surface of the piece undergoing direct flame impingement reaches the maximum allowable temperature, heat input into that portion of the surface is momentarily interrupted by either turning the burner off or moving the portion of the metal in contact with the flame away from the flame.. The metal piece, or the portion of the piece which had its surface at the maximum temperature, is kept out of contact with the flame for a period of time to permit the surface of the metal to cool between 100° F. and 500° F. During this time of cooling, the heat introduced into the surface of the metal is transferred by conduction toward the core of the metal shape being heated. When the surface temperature drops to a predetermined point, the burner again is turned on or the metal is brought back into contact with the flame and heating takes place for a like cycle. If the heating is done in a batch process, then the burner is simply turned on and off. If heating takes place in a continuous process, the metal surface can be moved passed continuously-firing, appropriately-spaced burners or passed intermittently firing burners to effect the desired "pumping" of heat into the product by intermittent direct flame impingement. The burner should be positioned so that there is between 4 and 8 inches between the flame end of the oxy-fuel burner and the surface of the article being heated.

For example, a 2 13/16" diameter round, medium carbon steel can be heated to a final temperature of 2225° F.±25° F. according to the process set forth below in Table 1.

TABLE 1

1) Final Temperature - 2225° F. ± 25° F.
Method - Single Zone Heating, On/Off Cycling, Multiple Firing Rates

| Step | Cycle Time on/Time off (sec) | Heat Flux (MM Btu · $hr^{-1}$ · $ft^{-2}$) |
|---|---|---|
| 1 | 65/00 | 1.16 |
| 2 | 10/05 | 0.96 |
| 3 | 06/07 | 0.96 |
| 4 | 05/08 | 0.96 |
| 5 | 04/09 | 0.96 |
| 6 | 04/10 | 0.96 |
| 7 | 03/10 | 0.86 |
| 8 | 03/10 | 0.86 |
| 9 | 03/10 | 0.86 |
| 10 | 03/05 | 0.66 |
| Total | 106/74 | Energy Consumed = 23,103 Btu/ft of bar |

The process according to that shown in Table 1 requires a precise control system to insure that the material will be heated without damage to the surface. Rapid and precise control of oxygen and fuel introduction, product temperature measurement and feedback, and sequencing of the burner or multiple burner firing is required. Such requirements can be met using automatic process control by computer. Furthermore, sequencing can be effected using computer modeling of the thermal profile within the piece being heated. The model is built using various composition dependent material properties, flame shapes and temperatures, piece/burner spatial arrangement, piece geometry and the like. The present invention relies upon burners that produce a total heat flux to the surface of the metal being heated between 0.5 million Btu/·$hr^{31\ 1}$·$ft^{-2}$ and 3 million Btu/·$hr^{-1}$·$ft^{-2}$ with a typical range of between 1.0 and 2.0 million Btu/·$hr^{-1}$·$ft^{-2}$. Furthermore, the firing rate can vary during the on time of the burner. The cycling of burner on/off (flame impingement on the article being heated) continues until the final introduction of temperature to the surface of the metal will result in total heating of the metal with an acceptable surface to core temperature gradient which is dictated by the material being heated.

Table 2 details a test wherein a 4" round cornered square medium carbon steel billet was heated according to the present invention.

TABLE 2

Trial #: 3A1
Test Material: 4" RCS Medium Carbon Steel (1040)
Initial Temperature: 40° F.
Final Temperature: 2080° F. ± 30° F.
Heating Time: 9 minutes
Heating Rate: 227° F./min. vs. Heating Rate (Conventional): 20–50° F./min
Method - Single Zone Heating, On/Off Cycling, Multiple Firing Rates

| Step | Cycle On time/Off time (sec) | (Heat Flux) (MM Btu · $hr^{-1}$ · $ft^{-2}$) |
|---|---|---|
| 1 | 120/10 | 1.125 |
| 2 | 30/10 | 1.125 |
| 3 | 15/15 | 1.50 |
| 4 | 15/15 | 1.50 |
| 5 | 10/10 | 1.50 |
| 6 | 10/10 | 1.50 |
| 7 | 10/10 | 1.50 |
| 8 | 10/10 | 1.50 |
| 9 | 10/10 | 1.125 |
| 10 | 10/10 | 1.125 |
| 11 | 10/10 | 1.125 |
| 12 | 10/10 | 1.125 |
| 13 | 08/10 | 1.125 |
| 14 | 08/10 | 1.125 |
| 15 | 08/10 | 1.125 |
| 16 | 08/10 | 1.125 |
| 17 | 08/70 | 1.125 |
| Total | 300/240 | |

As shown in Table 2, the total heating time for the billet was 9 minutes according to the present invention against a heating time of from 80 to 200 minutes if the billet was introduced into a conventional billet heating furnace maintained at the intended final temperature of 2080° F. Even running the furnace under a higher temperature (thermal head) would not significantly decrease the heating time nor approach the heating rate achieved with the process of the present invention.

Figure 2:
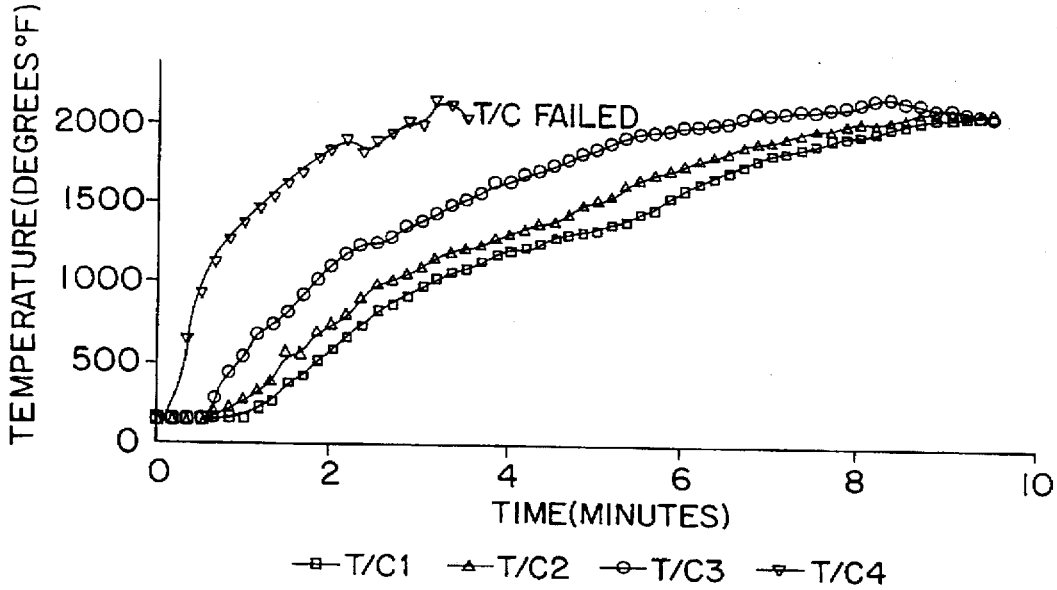
FIG. 2 is a plot of temperature against time at locations shown in the billet of FIG. 1.

FIG. 1 shows the location of four thermocouples placed in the billet used to gather the data for Table 2. FIG. 2 shows the temperature plotted against time for thermocouples 1–4 in the billet. Thermocouple 1 was at a depth of 2", thermocouple 2 at a depth of 1.5", thermocouple 3 at a depth of 1" and thermocouple 4 at a depth of 0.5".

It is apparent from the results shown in FIG. 2 that a process according to the present invention results in significantly increased heating rate by use of direct impingement of an oxy-hydrocarbon gas flame upon the surface of the product. Impinging the flame directly on the product applies ("pumps") the heat directly to the product. Conventional heating processes rely primarily on the more indirect method of heat radiation from refractory to the product.

In addition, shortening the heating time leads to improved surface condition (e.g., less scale on a steel sample) at the end of the heating cycle when compared to use of a conventional heating furnace.

A process according to the invention gives the user an effective means of increasing process throughput while avoiding these shortcomings of induction heating.

Having thus described our invention, what is desired to be secured by Letters Patent of the United States is set forth in the appended claims.

What is claimed is:

1. A process for rapid heating of a ferrous metal shape to a specified temperature which is required for a subsequent hot mechanical working operation of the ferrous metal shape to be heated, comprising the steps of:

exposing said ferrous metal shape to direct impingement by an oxy-fuel flame;

maintaining said oxy-fuel flame in contact with said ferrous metal shape until the temperature of the surface of said shape exceeds the maximum temperature to which the ferrous metal shape is to be heated, but below that at which surface damage begins to occur;

removing said oxy-fuel flame from contact with said ferrous metal shape until said surface temperature has decreased by at least 100° F.;

alternately impinging and removing said oxy-fuel flame onto said ferrous metal shape in accord with the previous step until said ferrous metal is heated substantially by direct flame impingement to the specified temperature where the surface to core temperature gradient is diminished to a level permitted by the requirements of the subsequent hot mechanical working operation for the ferrous metal shape, and subjecting the ferrous metal shape to a hot mechanical working operation.

2. A process according to claim 1 wherein said ferrous metal shape is positioned to within a maximum of eight inches from a flame end of an elongated oxy-fuel burner.

3. A process according to claim 1 wherein said ferrous metal shape is continuously passed into and out of contact with separate spaced-apart oxy-fuel flames.

4. A process according to claim 1 wherein said oxy-fuel flame creates a heat flux to the surface of said ferrous metal shapes varying between 0.5 million $Btu \cdot hr^{-1} \cdot ft^{-2}$ and 3.0 million $Btu \cdot hr^{-1} \cdot ft^{-2}$.

5. A process according to claim 4 wherein said heat flux is between 1.0 million $Btu \cdot hr^{-1} \cdot ft^{-2}$ and 2.0 million $Btu \cdot hr^{-1} \cdot ft^{-2}$.

6. A process according to claim 1 wherein said oxy-fuel flame is removed from contact with said ferrous metal shape until said surface temperature of said ferrous metal shape has decreased between 100° F. and 500° F.

7. A process according to claim 1 wherein said oxy-fuel flame is produced by a burner that is adapted for rapid turn on-turn off.

8. A process according to claim 1 wherein said oxy-fuel flame is created by a burner fired at a stoichiometric ratio necessary to fully oxidize all of the fuel component of the oxy-fuel flame.

9. A process according to claim 8 wherein said oxy-fuel flame is created by firing oxygen and natural gas at a ratio of two moles of oxygen to one mole of natural gas.

10. A process according to claim 1 wherein said ferrous metal shape is positioned within between four and eight inches from a flame end of an elongated oxy-fuel burner.

11. A process according to claim 10 wherein the burner is fired to create a total heat flux to the surface of between 0.5 million $Btu \cdot hr^{-1} \cdot ft^{-2}$ and 3.0 million $Btu \cdot hr^{-1} \cdot ft^{-2}$.

* * * * *